United States Patent [19]

Kadambi

[11] Patent Number: 4,928,296

[45] Date of Patent: May 22, 1990

[54] APPARATUS FOR COOLING AN X-RAY DEVICE

[75] Inventor: Vedanth Kadambi, Scotia, N.Y.

[73] Assignee: General Electric Company, Schenectady, N.Y.

[21] Appl. No.: 177,234

[22] Filed: Apr. 4, 1988

[51] Int. Cl.[5] ..... H01J 35/10

[52] U.S. Cl. ..... 378/141; 378/127; 378/130; 378/200

[58] Field of Search ..... 378/130, 141, 125, 127, 378/144, 199, 200

[56] References Cited

U.S. PATENT DOCUMENTS

| | | | |
|---|---|---|---|
| 3,694,685 | 9/1972 | Houston | 313/60 |
| 3,735,175 | 5/1973 | Blomgren, Jr. | 313/60 |
| 4,309,637 | 1/1982 | Fetter | 378/130 |
| 4,405,876 | 9/1983 | Iversen | 313/30 |
| 4,455,504 | 6/1984 | Iversen | 313/30 |
| 4,625,324 | 11/1986 | Blaskis et al. | 378/130 |
| 4,734,927 | 3/1988 | Leguen et al. | 378/141 |

FOREIGN PATENT DOCUMENTS

| | | | |
|---|---|---|---|
| 2058152 | 5/1972 | Fed. Rep. of Germany | 378/130 |

OTHER PUBLICATIONS

"High-Performance Heat Sinking for VLSI" by D. B. Tuckerman and R. F. W. Pease, IEEE Electron Device Letters, vol. EDL-3, No. 5, May 1981.

*Primary Examiner*—Carolyn E. Fields
*Assistant Examiner*—David P. Porta
*Attorney, Agent, or Firm*—William H. Steinberg; James C. Davis, Jr.; Paul R. Webb, II

[57] ABSTRACT

An X-ray generating tube with improved thermal performance comprises a stationary disc within a hollow rotating target disc. The target operates at the target metal temperatures limit. The stationary disc is cooled by forced convection with a dielectric liquid. Heat is transferred from the target inwardly and outwardly.

5 Claims, 3 Drawing Sheets

APPARATUS FOR COOLING AN X-RAY DEVICE

The present invention relates in general to X-ray generating devices and in particular to apparatus for cooling an X-ray generating device such as the X-ray tube of a computerized tomography (CT) scanner.

BACKGROUND OF THE INVENTION

High-powered X-ray devices of the type used in such fields as medical diagnostics and X-ray crystallography require an anode capable of dissipating a relatively large amount of heat. Since the primary mode of dissipating this heat is by radiative heat transfer from the anode, an increase in the radiating surface area, leads to greater heat dissipation. By rotating the anode, a fresh area of the target surface can be continuously presented to the beam of electrons emitted by the cathode and the heat generated during X-ray production can be advantageously spread over a larger area. Thus, anode rotation allows an X-ray device to be operated at generally higher power levels than a stationary anode device and the problem of target surface degradation found in devices that use a stationary anode is avoided, provided the temperature limits of the target surface material are not exceeded.

The amount of heat generated and the temperatures achieved by an X-ray device can be substantial. Because less than as 0.5% of the energy of the electron beam is converted into X-rays while a major portion of the remaining energy emerges as heat, the average temperature of the target surface of the rotatable anode can exceed 1200° C. with peak hot spot temperatures being substantially higher. The reduction of these temperatures and dissipation of the heat is critical to any increase in power. The ability to dissipate the generated heat by anode rotation alone, however, is nonetheless limited. As a consequence, even though there has been a demand for ever higher-powered devices since rotatable anodes were first introduced, the development of such devices has lagged.

A further disadvantage of prior art devices is their limited lifetime, which is determined in part by their ability to dissipate heat. Since X-ray devices can be relatively expensive, extending the lifetime of such a device will result in substantial cost savings.

In an X-ray device, it is primarily the bearings on which the anode shaft rotates, which determine the devices lifetime. The bearings used with a rotating anode are typically placed within the evacuated glass envelope to avoid the need for a rotating vacuum seal. Placing the bearings in this vacuum, however, necessitates the use of special lubrication, e.g. a silver coating placed on the bearing, which can itself be heat sensitive. The temperature of the bearings can at times exceed 400° C., due primarily to the conduction of heat from the anode through the shaft on which the anode turns and thereby into the bearings. Thus, a heat intensive hostile environment is created that can quickly result in the erosion of the bearings, leading to seizing of the shaft and ultimately to failure of the device.

Proper cooling in order to maintain the bearings of the X-ray device below a critical temperature of about 400° C. will advantageously extend the lifetime of the bearings and, hence, of the device itself. Such cooling is further desirable because it permits an increase in the peak and average power levels over and above that of existing X-ray devices, thus extending the capability and utility of such devices over those in use today.

The time averaged heat dissipation of the X-ray tube used in a CT scanner determines the patient throughput. It is estimated that the required average energy output of the pulsed electron beam is 12 kw. Present day CT scanner tubes dissipate approximately 3 kw. When the target of the X-ray tube overheats, as will happen if patient throughput is increased, the time between subsequent uses of the machine will have to be increased to allow the target to cool. An X-ray tube with higher dissipation will allow improved machine utilization.

Typical of prior art attempts at cooling X-ray devices is U.S. Pat. No. 4,455,504 to Iversen. As disclosed in this patent, cooling occurs by circulation of a fluid through the anode interior in direct contact with the interior surfaces of the anode. While such a system promotes cooling, it necessitates the use of rotary fluid seals. Since the seals are prone to leak, the reliability of such a device may be low and there is no assurance that the device will survive such a leak if it occurs.

It is an object of the present invention to provide a new and improved X-ray generating device that is not subject to the foregoing disadvantages.

It is another object of the present invention to provide a new and improved high-powered X-ray device which has a longer useful life than heretofore available devices of this type.

It is still another object of the present invention to provide a new and improved X-ray device having an increased heat dissipation rate which will permit continuous operation.

SUMMARY OF THE INVENTION

In accordance with the present invention there is provided an X-ray device incorporating a vacuum enclosure means enclosing a cathode capable of emitting an electron beam and a hollow rotatable anode spaced away from the cathode. The anode includes a hollow disk-shaped portion having a ring-shaped target track. The disc-shaped portion is affixed to a first tube extending axially therefrom. The interior of the hollow disc and the interior of the first tube are in flow communication with one another. The anode provides a target surface for the electron beam. A stationary insert having a disc-shaped portion is situated within the hollow rotatable anode structure and is spaced away therefrom. The stationary insert further comprises a second and third tube each affixed to the stationary disc-shaped portion, and extending coaxially therefrom. The second tube is spaced away from and surrounded by the first tube. The third tube is spaced away from and surrounded by the second tube. The stationary disc-shaped portion defines a passageway in flow communication with the interior of the third tube at one end, extends below the surface of the stationary disc-shaped portion and is in flow communication at the other end with the annular space formed between the second and third tubes. Bearing means rotatably mount the first tube on the second tube. Casing means surround the vacuum enclosure defining a passageway for liquid to flow over the vacuum enclosure.

The stationary insert thereby defines a continuous internal flow path through which a fluid may be circulated to remove heat generated at the anode as a by-product of the production of x-rays.

BRIEF DESCRIPTION OF THE DRAWING

The subject matter which is regarded as the invention is particularly pointed out and distinctly claimed in the concluding portion of the specification. The invention, however, both as to organization and method of practice, together with further objects and advantages thereof, may best be understood by reference to the accompanying drawing figures in which:

DETAILED DESCRIPTION OF THE INVENTION

Figure 1:
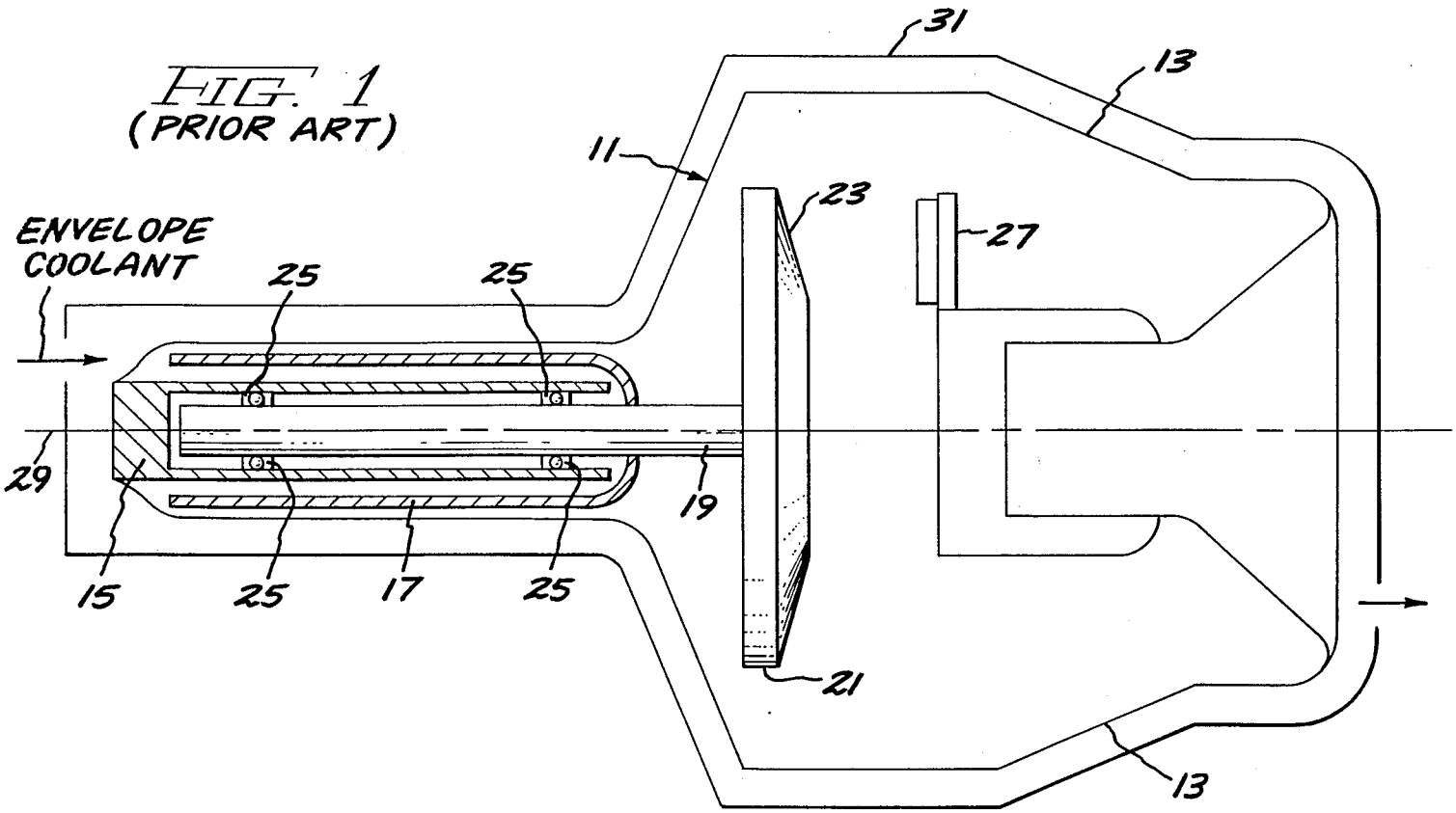
FIG. 1 (PRIOR ART)
FIG. 1 is cross-sectional view of a prior art X-ray device showing the solid rotatable anode in full.

An X-ray generating device 11, typical of prior art devices that use a rotatable anode, is illustrated in cross-section in FIG. 1. As shown, X-ray device 11 comprises an evacuated glass envelope 13 which encloses a rotatable disk-shaped anode 21. Anode 21 has an annular target surface 23 at the periphery of the forward wall of the anode and slightly angled with respect to the forward wall. The annular target surface comprises a tungsten alloy which is located on a wheel made of graphite or molybdenum. Further disposed within the glass envelope 13 is a cathode 27. The position of the cathode relative to anode 21 is such that the electron beam between them is substantially parallel with the axis of rotation 29 of the anode. Anode 21 is affixed to a shaft 19, which is rotatably supported by means of bearings 25. The anode and shaft rotate about axis 29 as a result of the electromagnetic interaction between a stator 15 and a rotor 17, the latter attached to shaft 19.

A small fraction of the electron beam's energy which strikes the target, is converted to X-rays. The X-rays leave the tube through the glass envelope. The remaining energy becomes heat which is radiated from the target and absorbed by the glass envelope and cooling oil which flows over the outer surface of the glass envelope contained by an outer casing 31. The cooling oil transports the heat to a heat exchanger (not shown).

Figure 2:
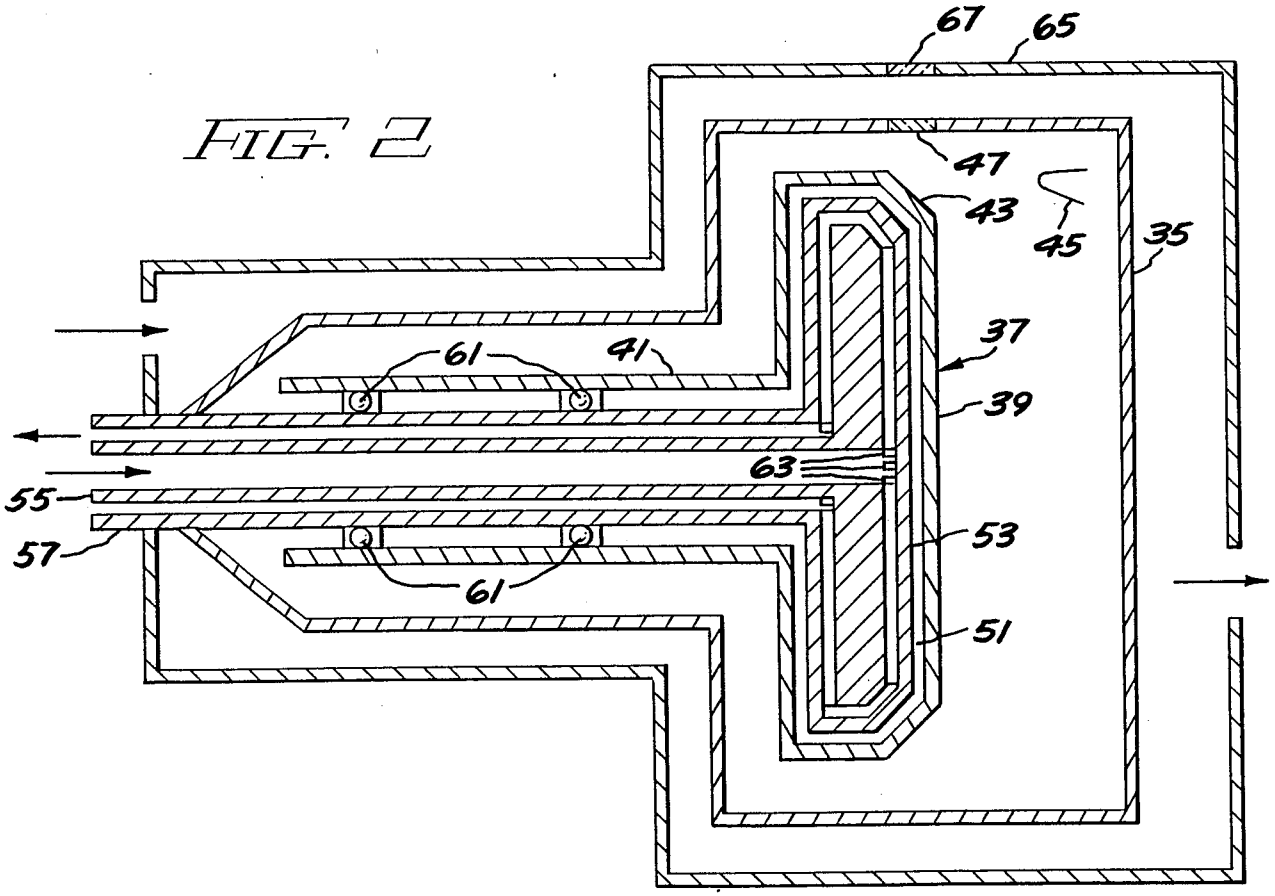
FIG. 2 is cross-sectional view of the X-ray tube of the present invention.
Figure 3:
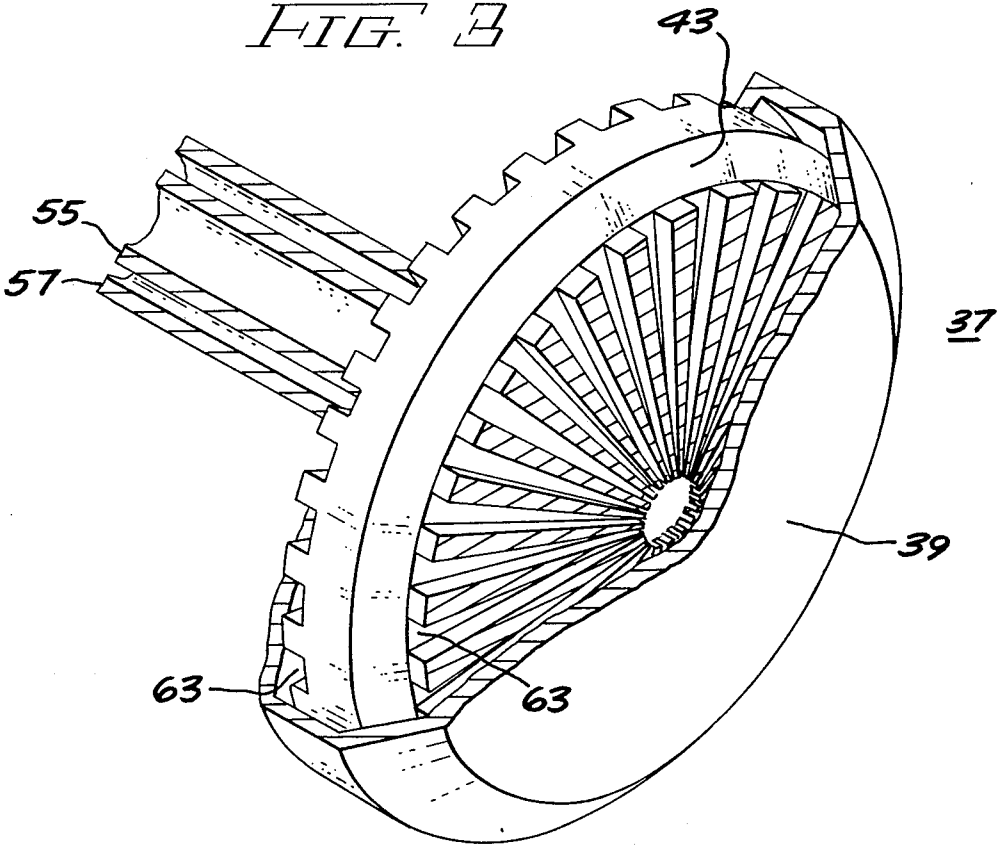
FIG. 3 is a partially cut away isometric view of the hollow rotatable anode of the present invention.

Referring now to FIGS. 2 and 3 wherein like elements are shown by like numerals, an embodiment of the present invention is shown. For the sake of clarity, features extraneous to the invention, such as the equipment shown in FIG. 1 for rotating the anode, have been omitted. FIG. 2 shows a cross section of an X-ray tube in which an evacuated envelope 35 encloses a hollow, rotatable anode 37. Anode 37 comprises a hollow disc-shaped portion 39 which is fabricated from a high conductivity material which can withstand high temperatures such as molybdenum. The disc-shaped portion is affixed such as by brazing to a first tube 41 which extends axially from the disc. The first tube can comprise high strength material such as stainless steel. The disc-shaped portion 39 has a chamfered rim 43 on the front face, which is the exterior face of the disc facing away from tube 41. The chamfered rim portion is covered with a tungsten-rhenium track which serves as the target. A cathode 45, shown symbolically, provides a small diameter, high energy electron beam which strikes the rotating rim of the disc causing a portion of the energy to be converted to X-rays, which escape through a quartz window 47 in the evacuable housing. Situated concentrically inside the hollow rotatable anode is a stationary insert 51 having a disc-shaped portion 53 and two tubes 55 and 57. Tube 55 is situated inside tube 57 and both are affixed to the disc portion 53 and extend axially therefrom. The stationary disc portion 53 and tube 57 are spaced away from the rotatable anode disc portion 39 and tube 41, respectively. The anode is rotatably mounted about the insert on bearings 61 which are situated between the tubes 55 and 57. Bearings 61 can be silver coated to provide dry lubrication for vacuum operation. The space between the disc-shaped portions 39 and 53 and tubes 55 and 57 are in flow communication with the interior of the evacuable envelope 35 so that when the envelope is evacuated the anode 37 can rotate entirely in a vacuum. Bearings 61 are also located in the evacuated space.

The stationary disc portion 53 defines a passageway in flow communication with the interior of the tube 55 which extends to the center of the disc just beneath the surface of the front of the disc. The central passage beneath the disc surface connects with a plurality of radially extending channels 63 which extend beneath the front face of the disc towards the disc perimeter into a manifold area beneath the insert disc periphery and then continues under the surface of the back of the disc through radial channels to connect with the annular passage formed between tubes 55 and 57.

The evacuable housing 35 is affixed to exterior of tube 57. A casing 65 surrounds the evacuable housing and is spaced away therefrom and has an inlet and outlet for the introduction and removal of a dielectric cooling fluid. A quartz window 67 in the casing aligned with the quartz window 47 in housing 35 permit X-rays to escape from the tube. The stationary insert can be fabricated from stainless steel as can the evacuated housing 35 and casing 65.

In operation, the electron beam from cathode 45 impinges on the rotating anode 37 generating X-rays which escape through the quartz windows 47 and 67. The impinging electron beam causes the anode 37 to heat. Heat is transferred from the rotating target by radiation through the vacuum gap surrounding the interior and exterior of the rotating anode. Heat is transferred from the front and back of the disc-shaped portion 39 to the housing 35 and from the interior surfaces of the rotating disc to the stationary disc-shaped portion 53 inside. To aid in radiation heat transfer a coating having a high emissivity at elevated temperatures is placed on the non-target surface of the disc-shaped portion 39 and a high absorptivity coating placed on the exterior of the disc-shaped portion of the stationary disc. In addition, both the inner surfaces undergoing radiation may be provided with appropriate fins to increase the heat transfer between the two. The stationary disc-shaped portion is cooled by forced convection with a dielectric liquid. The channels in the passageways in the insert increase the heat conductance between the stationary disc-shaped portion and the cooling liquid. For laminar flow in confined channels the heat transfer coefficient between the surface to be cooled and the liquid varies inversely with channel width, making microscopic channels desirable. The coolant viscosity determines the minimum practical channel width. Channel cross-sections with high aspect ratios further reduces thermal resistance. See the article entitled "High-Performance Heat Sinking for VLSI" by D. B. Tuckerman and R. F. W. Pease in IEEE Electron Device Letters, Vol. EDL-2, No. 5, May 1981. The direction of fluid flow is shown entering tube 55 flowing past the bearings 61 then flowing radially outward through the channels under the front face of the stationary disc into the manifold area. The flow then proceeds through channels under the back face of the stationary disc portion to the annulus formed between tubes 55 and 57. The direction of flow could alternatively be reversed with the fluid supplied to the annulus formed between discs 55 and 57 and after circulating through the stationary disc-shaped portion exiting from the interior of tube 55.

According to calculations, 12 kW of heat can be dissipated on average by the X-ray tube having a 4" diameter anode with envelope and stationary insert cooling by a dielectric liquid. The insert in the calculation had 168 tapered channels beneath each of the insert faces. The channels extended from a one-half inch diameter to a two and one-half inch diameter with channels having a cross section of 12×150 mils at the central portion expanding to 52×200 mils at the periphery with the larger dimension of the rectangular channel perpendicular to the insert face. The flow rate required is 19 gallons per minute at 4 atmospheres through the stationary insert of a liquid with high dielectric strength and thermal stability at elevated temperatures such as a perfluorinated fluorocarbon such as Fluoroinert® FC-75 available from the 3M Company. Increasing anode diameter will allow a larger stationary insert and aid in target cooling.

The foregoing describes an X-ray generating device with increased heat dissipation rate that does not require rotating vacuum seals.

While the invention has been particularly shown and described with reference to a preferred embodiment thereof, it will become obvious to those skilled in the art that various changes in form and details may be made without departing from the spirit and scope of the invention.

What is claimed is:

1. An X-ray generating tube comprising:

a hollow rotatable anode including a hollow disc-shaped portion having a ring-shaped target track, said disc-shaped portion affixed to a first tube extending coaxially from the disc-shaped portion, the interior of the hollow disc-shaped portion and the interior of the first tube being in flow communication with one another;

a stationary insert having a stationary disc-shaped portion situated inside the hollow disc-shaped portion of said anode and spaced away therefrom, said stationary insert further having a second and third tube, each being affixed to said stationary disc portion and extending coaxially therefrom, said second tube being spaced away from and surrounded by said first tube, said third tube being spaced away from and surrounded by said second tube, said stationary disc portion defining a passageway in flow communication with the interior of the third tube at one end, extending below the surface of the stationary disc portion and in flow communication at the other end with the annular space formed between the second and third tubes;

bearing means for rotatably mounting said first tube on said second tube;

cathode means directed at said ring shaped target for generating an electron beam; and vacuum enclosure means enclosing said hollow rotatable anode and said cathode means, said interior of said hollow rotatable anode in flow communication with the interior of said vacuum enclosure means.

2. The X-ray tube of claim 1, further comprising casing means for surrounding said vacuum enclosure defining a passageway for cooling liquid to flow over said vacuum enclosure means.

3. The tube of claim 1 wherein said passageway in said stationary disc portion comprises a plurality of channels beneath the surface of said stationary disc portion extending from the central portion of the disc toward the periphery.

4. The tube of claim 3 wherein said channels extend radially from the central portion beneath both circular faces of the stationary disc portion toward the perimeter of the stationary disc portion, the channels beneath both faces being in flow communication with one another.

5. A rotatable anode for an X-ray tube comprising:

a hollow rotatable disc-shaped member having two circular faces, one of said faces having a bevelled edge for a target region;

a first tube extending coaxially from the hollow disc-shaped member, the interior of the hollow disc-shaped member in flow communication with the first tube for allowing evacuation thereof; and a stationary insert including a stationary disc portion concentrically situated inside said rotatable hollow disc-shaped member and spaced away therefrom, said stationary insert further including a second and third tube, said second and third tube being affixed to the stationary insert and extending coaxially therefrom, said second tube being spaced away from and surrounded by said first tube, said third tube being spaced away from and surrounded by said second tube, said stationary disc portion defining a plurality of radially extending passageways beneath each face of the stationary disc portion, said passageways beneath each of the faces in flow communication with each other beneath the periphery of the stationary disc portion, the radially extending passageways beneath one face in flow communication with the interior of the third tube, the radially extending passageways beneath the other face in flow communication with the annular passageway formed between said second and third tube.

* * * * *